US005836489A

United States Patent [19]

Swetish

[11] Patent Number: 5,836,489

[45] Date of Patent: Nov. 17, 1998

[54] BELT ASSEMBLY FOR A LOAD CARRYING SYSTEM

[75] Inventor: Thomas R. Swetish, Racine, Wis.

[73] Assignee: Johnson Worldwide Associates, Inc., Sturtevant, Wis.

[21] Appl. No.: 762,569

[22] Filed: Dec. 9, 1996

[51] Int. Cl.[6] ..... A45F 3/08

[52] U.S. Cl. ..... 224/262; 224/627; 224/637; 224/641; 224/662

[58] Field of Search ..... 224/262, 627, 224/637, 641, 211, 212, 215, 216, 901.8, 662, 619, 625, 934, 904; 602/19

[56] References Cited

U.S. PATENT DOCUMENTS

| | | | |
|---|---|---|---|
| 2,691,399 | 10/1954 | Tompkins | 224/625 |
| 3,065,888 | 11/1962 | Lande | 224/934 |
| 3,355,075 | 11/1967 | Dean . | |
| 3,831,827 | 8/1974 | Olson | 224/25 A |
| 4,015,759 | 4/1977 | Dreissigacker et al. | 224/25 A |
| 4,049,164 | 9/1977 | Sullivan et al. | 224/500 |
| 4,099,657 | 7/1978 | Zufich . | |
| 4,194,656 | 3/1980 | Zufich | 224/211 |
| 4,298,149 | 11/1981 | Gottschalk et al. | 224/262 |
| 4,318,502 | 3/1982 | Lowe et al. | 224/153 |
| 4,438,763 | 3/1984 | Zablen . | |
| 4,676,418 | 6/1987 | Lowe . | |
| 5,152,443 | 10/1992 | Hagan | 224/662 |
| 5,184,764 | 2/1993 | Orovan et al. | 224/262 |
| 5,240,159 | 8/1993 | Gregory | 224/209 |
| 5,361,955 | 11/1994 | Gregory | 224/211 |
| 5,464,136 | 11/1995 | Eddy | 224/901.8 |
| 5,465,886 | 11/1995 | Scherer . | |

FOREIGN PATENT DOCUMENTS

| | | |
|---|---|---|
| 597307 | 5/1990 | Australia . |
| 0 692 206A1 | 6/1995 | European Pat. Off. . |
| 2586539 | 3/1987 | France . |
| 2 630 897 | 11/1989 | France . |
| 2754061 | 6/1979 | Germany . |
| 3918346 | 12/1990 | Germany . |
| 9211361 | 12/1992 | Germany . |
| 335 811 | 3/1959 | Switzerland . |
| WO 97/49312 | 12/1997 | WIPO . |

*Primary Examiner*—David J. Walczak
*Assistant Examiner*—Timothy L. Maust
*Attorney, Agent, or Firm*—Foley & Lardner

[57] ABSTRACT

A belt assembly is pivotally connected to a load support structure of a load carrying system and includes a rear panel and a pair of lateral panels. The lateral panels are pivotally coupled to the rear panel. When the belt assembly is worn, the rear panel covers a user's lumbar region and the lateral panels wrap around the user's hips. The belt assembly includes a removable pad which is preferably connected to the rear and lateral panels by a hook and loop fastener system. A strap secures the belt assembly around the user's hips. The pivotal connections between the panels of the belt assembly and between the belt assembly and the load support system enable the belt assembly to afford a user considerable freedom of movement when worn.

31 Claims, 2 Drawing Sheets

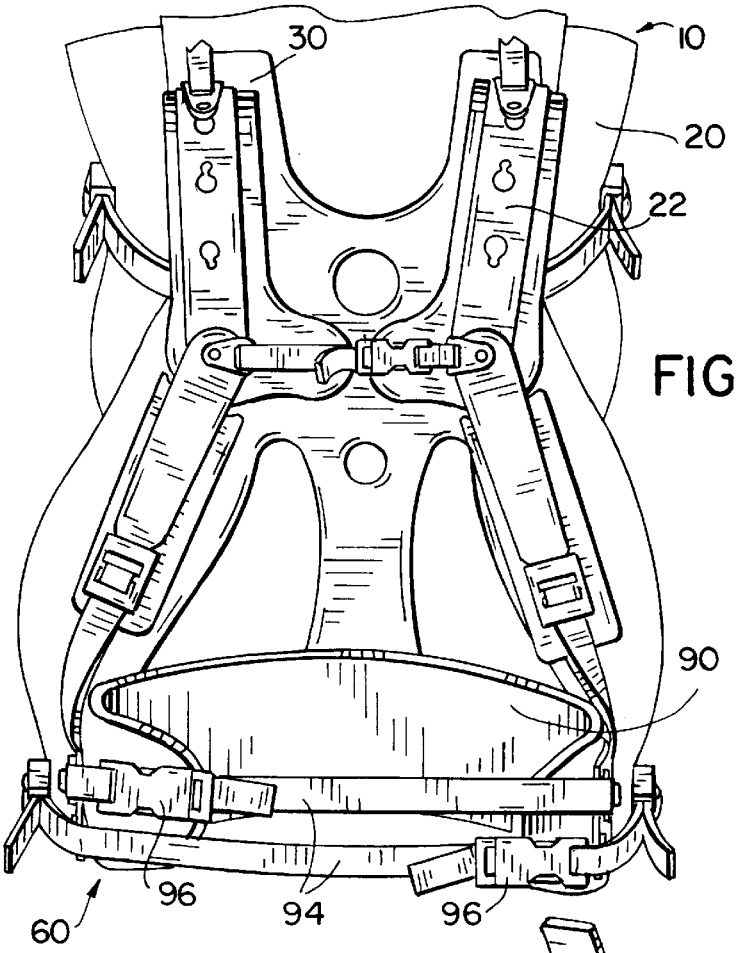
FIG. 1
FIG. 2
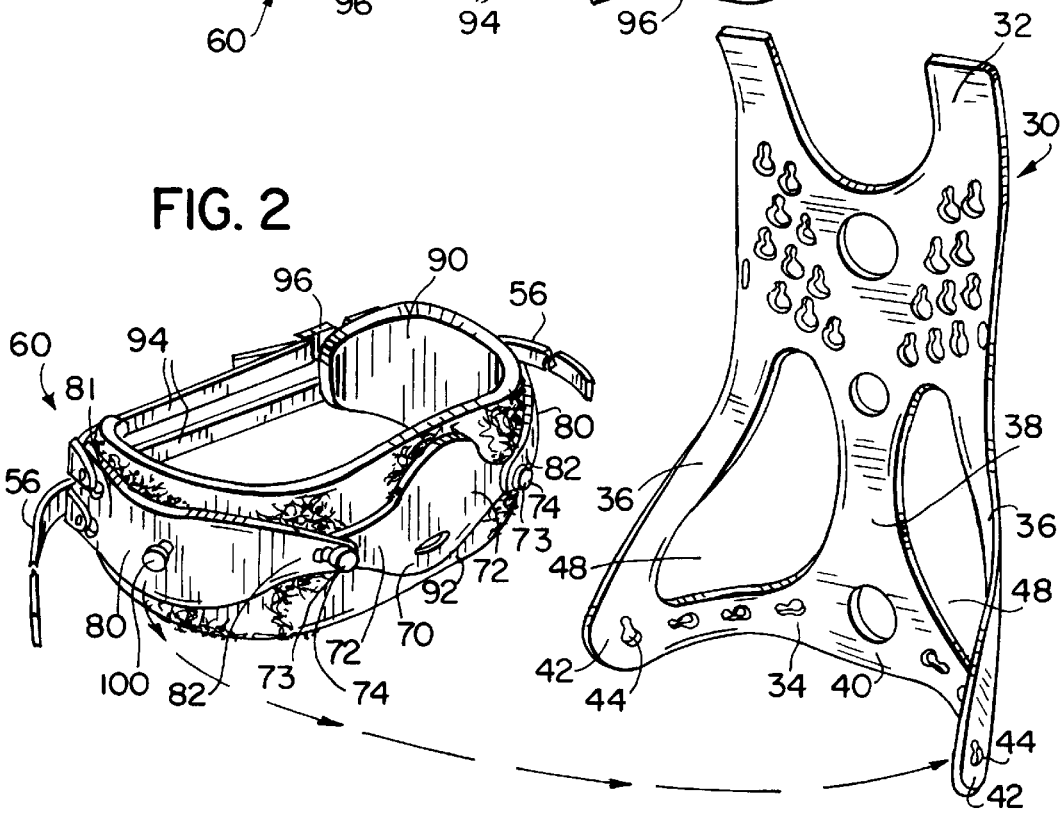

BELT ASSEMBLY FOR A LOAD CARRYING SYSTEM

BACKGROUND OF THE INVENTION

The present invention relates generally to a load carrying system for supporting and carrying loads on a user's back and hips. More particularly, the present invention relates to a belt assembly for a load carrying system for adequately and comfortably supporting a load, such as a backpack, a buoyancy compensator having tanks or other loads, on a user's back and hips while providing the user with considerable freedom of movement.

Conventional backpacks and similar structures for supporting loads on a user's back typically include a load carrying compartment and shoulder straps. While small capacity packs often require no other support structure for comfortably supporting the load, larger capacity packs and carrying systems, such as buoyancy compensators for divers, often include a rigid frame structure and a hip strap designed to lend additional support to the load and to distribute the load properly on the user's back and hips, thereby removing strain from the back which, over time, may lead to fatigue and pain in the muscle and joints of the back.

One problem with larger load carrying systems is that internal or external frames may make the load carrying systems awkward for the user. Rigid frames often severely limit the user's freedom of movement, resulting in a somewhat clumsy structure that can be unwieldy when performing sports such as trekking, climbing, skiing and the like.

There is a need, therefore, for an improved belt assembly for a load carrying system that offers effective load support on the user's hips while allowing the user considerable freedom of movement.

SUMMARY OF THE INVENTION

The present invention features a novel belt assembly for a load carrying system designed to respond to these needs. In particular, the invention provides a belt assembly having several panels which pivot with respect to each other, thereby adjusting to the movements of the user's hips. Further, the belt assembly is pivotally connected to a load support structure, allowing the belt assembly to swing or pivot with respect to the load support structure and thereby to accommodate the user's bending about the abdomen or waist.

Thus, in accordance with one aspect of the invention, a belt assembly is provided for a load carrying system. The load carrying system includes a load support structure configured to support a load, such as a backpack or a buoyancy compensator, on a user's back. The belt assembly includes a rear panel and a pair of lateral panels. The rear panel is designed to cover the user's lumbar region. The lateral panels are pivotally coupled to the rear panel and are configured to be wrapped around the user's hips. The belt assembly further includes a strap that is connected to a free end of each of the lateral panels and is configured to secure the belt assembly around the user's hips.

In accordance with another aspect of the invention, a system for supporting a load on a user's back and hips includes a load carrying system, a rear panel, a pair of lateral panels and at least one strap. The rear panel is configured to cover the user's lumbar region. The lateral panels are pivotally connected to the rear panel and are configured to be wrapped around the user's hips. The lateral panels are also coupled to the load carrying system. At least one strap is connected to a free end of each lateral panel and is configured to secure the belt assembly around the user's hips.

In accordance with a further aspect of the invention, a belt assembly is provided for at least partially supporting a load carrying system on a user's hips. The belt assembly includes a rear panel configured to cover the user's lumbar region, a pair of lateral panels pivotally coupled to the rear panel and at least one pad removably coupled to the belt assembly. The lateral panels are configured to be wrapped around the user's hips. The belt assembly further includes means for removably coupling the belt assembly to the load carrying system and means, connected to the lateral panels, for securing the belt assembly around the user's hips.

BRIEF DESCRIPTION OF THE DRAWINGS

The present invention will become more fully understood from the following detailed description, taken in conjunction with the accompanying drawings, wherein like reference numerals refer to like parts, in which:

FIG. 1 is a perspective view of a belt assembly coupled to a load carrying system including a backpack;

FIG. 2 is a partially exploded perspective view of the system shown in FIG. 1 removed from the backpack and showing the belt assembly removed from a load support structure;

DESCRIPTION OF THE PREFERRED EMBODIMENTS

Figure 3:
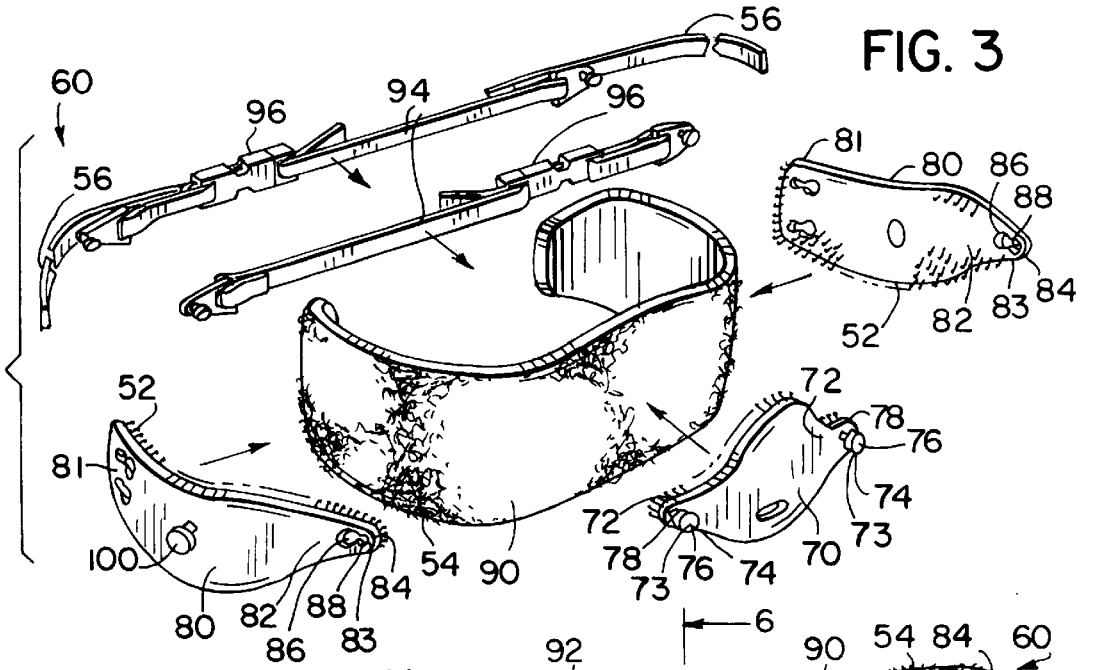
FIG. 3 is an exploded perspective view of the belt assembly shown in FIGS. 1 and 2.

Turning now to the drawings and referring to FIG. 1, a load carrying system 10 is illustrated as adapted for supporting and carrying a backpack 20 on the shoulders and hips of a user (not shown). As illustrated in FIG. 1, load carrying system 10 includes a frame or load support structure 30, a shoulder strap assembly 22 and a belt assembly 60.

As best illustrated in FIG. 2, load support structure 30 includes an upper portion 32 and a lower portion 34. Extending from upper portion 32, lower portion 34 forms left and right struts 36 that join a lower panel 40 at respective lower corners 42. Between struts 36, lower portion 34 preferably includes a central panel 38 separated from struts 36 by open regions 48.

In the preferred embodiment shown, load support structure 30 is formed from a unitary piece of plastic, such as by die cutting or molding. It should be noted, however, that as used herein, the term "unitary" refers to the final construction of load support structure 30 rather than any particular method of manufacture. Thus, a welded, fused or glued assembly of elements forming a similar structure would be considered, for present purposes, to be a unitary structure. Moreover, while in the presently preferred embodiment load support structure 30 is formed from 3/16 inch thick ABS plastic sheet, other flexible materials may be substituted. The material forming load support structure 30 may be thermoformed, such as by drape molding to lend load support structure 30 a bow or camber curving inwardly toward the user. Where load support structure 30 is to be used for particularly heavy loads or where additional flexure is desired, one or more additional strips of flexible material may be secured, such as by gluing or fusing, to each strut 36 to increase its column and bending loading capacity without unnecessarily increasing the overall thickness or weight of other portions of load support structure 30.

As will be appreciated by those skilled in the art, the flexibility of load support structure 30 permits elastic deformation during use, allowing load support structure 30 to move with the user, particularly through twisting-type movements of the waist and torso. In addition, while permitting such movement, struts 36 are generally placed in compression to effectively transmit loads on load support structure 30 to belt assembly 60, thereby allowing the user to carry a greater portion of the load on the hips and legs, and relieving the shoulders and back from overloading.

Figure 4:
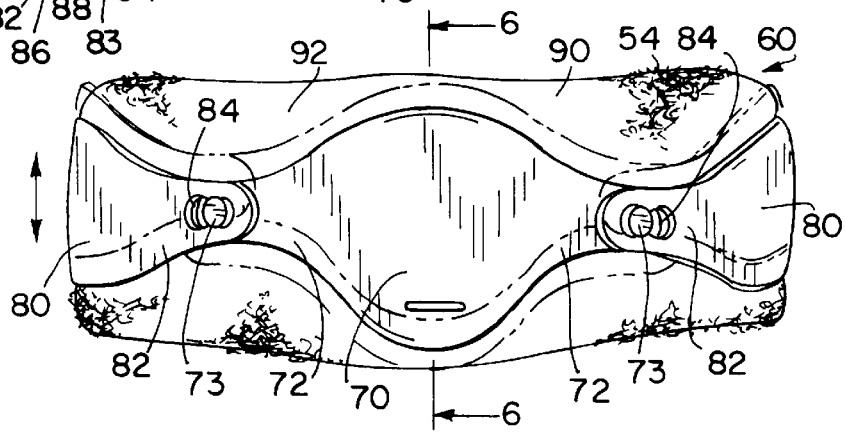
FIG. 4 is a rear perspective view of the belt assembly of FIG. 3.
Figure 5:
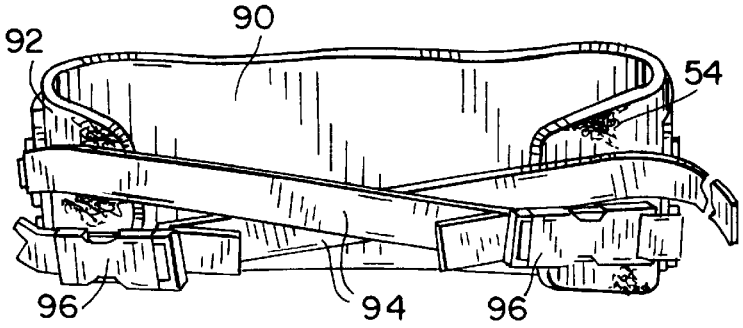
FIG. 5 is a front perspective view of the belt assembly showing the pair of straps in an alternate cross-over configuration.

As best illustrated in FIGS. 2, 3 and 4, belt assembly 60 includes a rear panel 70 and a pair of lateral panels 80. Rear panel 70 and lateral panels 80 are preferably made of a sturdy plastic material, such as polypropylene. This semi-rigid plastic material provides comfortable load support, while permitting considerable adjustability to adapt the support configuration to the user. Rear panel 70 is designed to cover the user's lumbar region, while each lateral panel 80 is configured to wrap around a hip of the user. Lateral panels 80 have a free end 81 and an attachment end 82. Each lateral panel 80 is pivotally connected at attachment end 82 to a respective end 72 of rear panel 70. Attachment supports 73 of rear panel 70 are coupled to attachment points 83 of lateral panels 80, as best shown in FIG. 3, by aligning attachment supports 73 with attachment points 83 and snapping each into engagement therewith. In the preferred embodiment, each attachment support 73 includes a support pin 74. Support pin 74 has an enlarged, cylindrical head portion 76 and a shank portion 78. Each attachment point 83 includes an elongate opening 84 having an enlarged end 86 and an end 88 of reduced dimensions for receiving and establishing coupling engagement with shank portion 78 of support pin 74.

Belt assembly 60 is releasably coupled to lower portion 34 of load support structure 30, as shown in FIG. 2. Each lateral panel 80 has a mounting support 100. Mounting supports 100 are similar in configuration to attachment supports 73. Each corner 42 of lower portion 34 of load support structure 30 has a mounting point 44 for attachment of belt assembly 60. Mounting points 44 are similar in configuration to attachment points 83. Thus, belt assembly 60 is attached to load support structure 30 by aligning mounting supports 100 with mounting points 44 and snapping them into engagement therewith. Such engagement preferably requires additional bowing or deformation of load support structure 30, placing a portion of belt assembly 60 between attachment supports 62 somewhat in tension. The additional bowing of load support structure 30 creates a venting or air flow space (not shown) between load support structure 30 and belt assembly 60. This spacing holds backpack 20 away from the user's back and facilitates evaporation of perspiration from the user's back, further enhancing the comfort of load carrying system 10.

Belt assembly 60 also includes a removable pad 90. In a preferred embodiment belt assembly includes several removable pads (not shown) with each pad being configured to its respective panel. The use of multiple pads provides several advantages, including facilitation of manufacture and reduction of scraps, particularly where such pads are formed and die-cut from prefabricated stocks of fixed dimensions.

Figure 6:
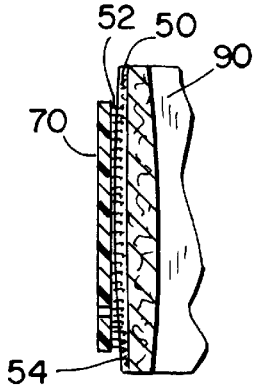
FIG. 6 is a cross-section view of the belt assembly taken generally along line 6—6 of FIG. 4.

Removable pad 90 is preferably attached to the belt assembly panels via a hook and loop fastener system 50. In the preferred embodiment, a hook portion 52 of hook and loop fastener system 50 is integrally molded in rear panel 70 and lateral panels 80, as shown in FIGS. 3 and 6. Removable pad 90 has a back face 92 on which is attached a loop portion 54 of hook and loop fastener system 50. Removable pad 90 provides several advantages over an attached pad of the type found in conventional load carrying systems. First, the exact position of a removable pad on the belt assembly can be tailored to each user. Second, removable pads of various thicknesses are interchangeable with the same belt assembly. Finally, removable pads facilitate cleaning as they may be detached from the belt assembly, washed separately and then reattached.

It should be noted that, while in use belt assembly 60 may support a considerable portion of the load within backpack 20. Connection between rear and lateral panels 70 and 80, respectively, and pad 90 will be adequately maintained due to the character of the loading of pad 90 and the resistance of hook and loop fastener system 50 to sliding movement of these elements with respect to one another. This preferred embodiment permits belt assembly 60 to provide comfortable and effective load support, while eliminating the need for stitching through pad 90 as in conventional designs.

As shown in FIGS. 1, 2, 3 and 5, belt assembly 60 further includes webbing straps 94 for selectively securing belt assembly around the user's hips. Webbing straps 94 are pivotally coupled to free ends 81 of lateral panels 80 and may be selectively jointed by an adjustable buckle such as quick release buckle 96. Webbing straps 94 of belt assembly 60 may be secured around the user with webbing straps 94 in a parallel configuration as in FIG. 1 or, alternatively, in a cross-over configuration as in FIG. 5. In addition to webbing straps 94, stabilizing straps 56, preferably sewn to webbing straps 94, extend toward backpack 20, and may be coupled to backpack 20 for stabilizing backpack 20 in a manner generally known in the art.

When belt assembly 60 is worn, webbing straps 94 allow the user to control the angle of lateral panels 80, thereby conforming lateral panels 80 to the user's hips. One advantage of having two webbing straps 94 is that lateral panels 80 may be individually adjusted to maximize the user's comfort. In addition, this two-strap configuration facilitates securing of belt assembly 60 around the user. Belt assembly 60 is tightened by pulling webbing straps 94 in opposite directions across the user's body. Since webbing straps 94 are pulled in opposite directions, less force is required to tighten belt assembly 60, and the user may evenly tighten both sides of belt assembly 60 through a simple, comfortable opposing motion.

While the embodiments illustrated in the Figures and described above are presently preferred, it should be understood that these elements are offered by way of example only and may be adapted to various other structures. For example, the belt assembly could be used with a variety of frames, both internal and external. Moreover, various alternative engagement configurations may be envisioned in place of the pin and slot arrangements described. Also, while it is preferred that the pivotal belt assembly is detachable from the load carrying system, the belt assembly could be permanently or semi-permanently attached to the load support structure. In addition, the hook portion of the hook and loop fastener system could be attached to the rear and lateral panels by glue or ultrasonic welding, and in place of the hook and loop fastener system, snaps or other hook fasteners could attach the pads to the panels. Moreover, the pads need not be removable, but can be attached by plastic rivets or any other known technique. Finally, the belt assembly could employ a single webbing strap, rather than two. Moreover, in the two belt configuration a single quick release buckle may be used, instead of two, to facilitate fastening of the straps. These and other modifications may be made in the design and arrangement of other elements without departing from the scope of the invention as expressed in the appended claims.

I claim:

1. A belt assembly for a load carrying system including a load support structure configured to support a load on a user's back, the belt assembly comprising:

a rear panel having two ends and being configured to cover a lumbar region of the user, the rear panel having a length that extends generally in a first plane; and a pair of lateral panels adapted to be coupled to the load carrying system, each lateral panel configured to be pivotally connected at a first location, substantially rearward of the user's hips, to each respective end of the rear panel and configured to be wrapped around a hip of a user, the lateral panels being configured to distribute the load on the user's back to the user's hips and having free ends coupled to one another, each lateral panel being rotatable about an axis substantially oblique to the plane in which the length of the rear panel extends.

2. The belt assembly as recited in claim 1, wherein the rear panel and the pair of lateral panels are made of a semi-rigid plastic material.

3. The belt assembly as recited in claim 1, wherein the pair of lateral panels is adapted to be removably secured to the load support structure, whereby the belt assembly may be separated from the load support structure while the rear panel remains attached to the lateral panels.

4. The belt assembly as recited in claim 1, wherein each of the pair of lateral panels has a length that extends within a second plane and wherein each of the lateral panels is adapted to be pivotally coupled at a second location to the load carrying system, each lateral panel being rotatable about an axis at the second location oblique to the second plane in which the length of the lateral panel extends.

5. The belt assembly as recited in claim 4, wherein the second location is spaced substantially equidistantly from the first location and the free end of the respective lateral panel.

6. The belt assembly as recited in claim 1, further comprising at least one pad removably coupled to the belt assembly for cushioning the belt assembly around the user's hips.

7. The belt assembly as recited in claim 5, wherein the at least one pad is removably coupled to the belt assembly by a hook and loop fastener system.

8. The belt assembly as recited in claim 7, wherein a hook portion of the hook and loop fastener is integrally molded in the rear panel and in the pair of lateral panels.

9. The belt assembly as recited in claim 1, further comprising a pair of straps, each strap having a quick release buckle at one end, the straps coupled to the free ends of the pair of lateral panels such that the quick release buckles are disposed on opposite sides of the user, the belt assembly being tightened by pulling the pair of straps in opposite directions.

10. The belt assembly as recited in claim 1, wherein each lateral panel is adapted to be directly coupled to the load carrying system.

11. A system for supporting a load on a user's back and hips, the system comprising:

a rear panel having two ends and being configured to cover a lumbar region of a user;

a pair of lateral panels coupled to the load carrying system, each lateral panel configured to be pivotally connected at a first location, substantially rearward of the user's hips, to each respective end of the rear panel and configured to be wrapped around a hip of the user, each lateral panel being configured to distribute the load to the user's hips and having a free end opposite the rear panel; and a load carrying system for supporting the load on the user's back, the load carrying system having at least semi-rigid first and second struts coupled to the pair of lateral panels, whereby the struts are placed in compression to transfer load to the lateral panels.

12. The system as recited in claim 11, wherein the rear panel and the pair of lateral panels are made of a semi-rigid plastic material.

13. The system as recited in claim 11, wherein the pair of lateral panels is adapted to be removably secured to the load support structure, whereby the belt assembly may be separated from the load support structure while the rear panel remains attached to the lateral panels.

14. The system as recited in claim 11, wherein each of the pair of lateral panels has a length that extends within a second plane and wherein each of the lateral panels is pivotally coupled at a second location to the load carrying system, each lateral panel being rotatable about an axis at the second location oblique to the second plane in which the length of the lateral panel extends.

15. The system as recited in claim 14, wherein the second location is spaced substantially equidistantly from the first location and the free end of the respective lateral panel.

16. The system as recited in claim 11, further comprising a pad, the pad removably coupled to the rear panel and to the pair of lateral panels by a hook and loop fastener system.

17. The system as recited in claim 16, wherein a hook portion of the hook and loop fastener is integrally molded in the rear panel and in the pair of lateral panels.

18. The system as recited in claim 11, wherein each lateral panel is directly coupled to the load carrying system.

19. The system as recited in claim 11, further comprising at least one strap configured to conform the belt assembly to the user's hips, the at least one strap connected to the free end of each respective lateral panel, the belt assembly being tightened by pulling the at least one strap in a direction generally across the user's body.

20. The system as recited in claim 19, wherein the at least one strap has a quick release buckle.

21. The system as recited in claim 11, wherein the rear panel has a length that extends generally in a plane, each lateral panel being rotatable about an axis substantially oblique to the plane.

22. A belt assembly for at least partially supporting a load carrying system on a user's hips, the belt assembly comprising:

a rear panel having two ends and being configured to cover a lumbar region of a user, the rear panel extending generally in a plane;

a pair of lateral panels, each lateral panel configured to be pivotally connected substantially rearward of the user's hips to each respective end of the rear panel and having a free end opposite the rear panel, each lateral panel being rotatable about an axis substantially perpendicular to the plane, the pair of lateral panels configured to be wrapped around and to distribute the load to the user's hips;

at least one pad removably coupled to the belt assembly;

means for conforming the belt assembly to the user's hips, the conforming means connected to the free end of each respective lateral panel; and a pair of pivot pins extending between the belt assembly and load carrying system for removably coupling the belt assembly to the load carrying system.

23. The belt assembly as recited in claim 22, wherein the at least one pad is removably coupled to the belt assembly by a hook and loop fastener system.

24. The belt assembly as recited in claim 22, wherein the conforming means comprises at least one strap interconnecting the pair of lateral panels.

25. A belt assembly for a load carrying system including a load support structure configured to support a load on a user's back, the belt assembly comprising:

a rear panel having two ends and being configured to cover a lumbar region of the user; and a pair of lateral panels adapted to be coupled to the load carrying system, the lateral panels configured to be pivotally connected at a first location to each respective end of the rear panel and to be wrapped around a hip of a user, the lateral panels adapted to be coupled at a second location to the load carrying system and configured to distribute the load on the user's back to the user's hips, the second location being spaced substantially equidistantly from the first location and the free end of the respective lateral panel.

26. The belt assembly as recited in claim 25, wherein the first location is substantially rearward of the user's hip bone and the second location is in alignment with the user's hip bone.

27. The belt assembly as recited in claim 25, wherein the rear panel has a length that extends generally in a plane, each lateral panel being rotatable about an axis substantially oblique to the plane.

28. A system for supporting a load on a user's back and hips, the system comprising:

a load carrying system for supporting the load on the user's back;

a rear panel having two ends and being configured to cover a lumbar region of a user, the rear panel having a length that extends generally in a plane;

a pair of lateral panels coupled to the load carrying system, each lateral panel pivotally connected to each respective end of the rear panel and configured to be wrapped around a hip of the user, each lateral panel being configured to distribute a portion of the load on the user's back to the respective hip and having a free end opposite the rear panel, each lateral panel being rotatable about an axis substantially oblique to the plane in which the length of the rear panel extends;

at least one strap configured to conform the belt assembly to the user's hips, the at least one strap connected to the free ends of the lateral panels; and a pad removable coupled to the rear panel and to the pair of lateral panels by a hook and loop fastener system.

29. A belt assembly for at least partially supporting a load carrying system on a user's hips, the belt assembly comprising:

a rear panel having two ends and being configured to cover a lumbar region of a user;

a pair of lateral panels, each lateral panel pivotally connected to each respective end of the rear panel and having a free end opposite the rear panel, the pair of lateral panels configured to be wrapped around the user's hips;

means for removably coupling the belt assembly to the load carrying system, the coupling means including a pair of pivot pins extending between the belt assembly and the load carrying system;

at least one pad removably coupled to the belt assembly; and means for conforming the belt assembly to the user's hips, the conforming means connected to the free ends of the lateral panels.

30. A belt assembly for at least partially supporting a load carrying system on a user's hips, the belt assembly comprising:

a rear panel having two ends and being configured to cover a lumbar region of a user;

a pair of lateral panels, each lateral panel configured to be pivotally connected substantially rearward of the user's hips to each respective end of the rear panel and having a free end opposite the rear panel, the pair of lateral panels configured to be wrapped around the user's hips;

a pair of pivot pins adapted to extend between the belt assembly and the load carrying system, the pivot pins adapted to couple the belt assembly to the load carrying system;

at least one pad removably coupled to the belt assembly; and means for conforming the belt assembly to the user's hips, the conforming means connected to the free end of each respective lateral panel.

31. A belt assembly for a load carrying system including a load support structure configured to support a load on a user's back, the belt assembly comprising:

a rear panel having two ends and being configured to cover a lumbar region of the user; and a pair of lateral panels adapted to be coupled to the load carrying system, each lateral panel configured to be pivotally connected at a first location, substantially rearward of the user's hips, to each respective end of the rear panel and configured to be wrapped around a hip of a user, the lateral panels being configured to distribute the load on the user's back to the user's hips and having free ends coupled to one another, the lateral panels adapted to be removably secured to the load support structure, whereby the belt assembly may be separated from the load support structure while the rear panel remains attached to the lateral panels.

* * * * *